US005513468A

United States Patent [19]

Diestelmeier

[11] Patent Number: 5,513,468

[45] Date of Patent: May 7, 1996

[54] WINDOW LIFT BRACKET

[75] Inventor: Stephen Diestelmeier, Rockford, Ill.

[73] Assignee: Textron Inc., Providence, R.I.

[21] Appl. No.: 386,020

[22] Filed: Feb. 9, 1995

[51] Int. Cl.[6] ..... E05F 11/38

[52] U.S. Cl. ..... 49/375; 49/351

[58] Field of Search ..... 49/375, 374, 376, 49/351, 350

[56] References Cited

U.S. PATENT DOCUMENTS

| | | | |
|---|---|---|---|
| 4,026,088 | 5/1977 | Akabane | 49/351 X |
| 4,449,326 | 5/1984 | Hori et al. | 49/375 |
| 4,663,901 | 5/1987 | Ichinohe | 49/375 X |
| 4,987,699 | 1/1991 | Gold | 49/375 |
| 4,991,351 | 2/1991 | Bertolini | 49/375 X |
| 5,065,545 | 11/1991 | Kane et al. | 49/375 |

FOREIGN PATENT DOCUMENTS

| | | | |
|---|---|---|---|
| 48301 | 1/1983 | Japan | 49/375 |

*Primary Examiner*—Philip C. Kannan
*Attorney, Agent, or Firm*—Trexler, Bushnell, Giangiorgi & Blackstone, Ltd.

[57] ABSTRACT

A window lift bracket for attachment to a mounting edge of a movable window and which is connectable to a window lifting mechanism. The window lift bracket includes a base which is attachable to the window lifting mechanism and spaced apart portions extending from the base being positionable on either side of the movable window. The spaced apart portions define a channel therebetween. Opposing surfaces of the spaced apart portions include protrusions which abut corresponding surfaces of a window placed in the channel. Depressions are defined by the protrusions and are adapted for receiving an adhesive placed in the channel and effectively increasing the surface area contact of the adhesive on the window bracket thereby improving the adhesion of the adhesive to the window bracket and window. Further, the bracket is integrally formed of a suitable plastics material compatible with the adhesive used to attach the bracket to the window.

17 Claims, 1 Drawing Sheet

WINDOW LIFT BRACKET

BACKGROUND OF THE INVENTION

The present invention pertains to a bracket for attachment to a movable window and connection to an automotive window lifting mechanism.

In vehicles, and especially automobiles, it is highly desirable to have movable windows. With reference to automobiles, windows are displaceable upwardly and downwardly relative to a door assembly by use of a manual crank or an electrically driven window lifting mechanism. Many window lifting mechanisms include a scissoring linkage which transfers motion from a manual crank or electric drive to a window connected to the window lifting mechanism. The scissoring linkage is used in order to limit the movement of the window in a generally vertical direction. A cross member is attached to the scissoring linkage to provide a support for the movable window.

Mounting brackets or window lift brackets are often used to attach the movable window to the cross member attached to the scissoring linkage. These brackets generally are attached to a mounting edge of the window at two spaced apart locations and a portion of the bracket is attached to the window lifting cross member.

Prior art brackets presented many problems in a movable window assembly, are difficult to manufacture, and are relatively expensive. With regard to the problems associated with prior art window lift brackets, these brackets are typically manufactured from a stamped strip of metal which has been deformed to a specified bracket configuration. These deformed metal components are subject to damage and failure as the result of corrosion thereby providing a weak link in the movable window assembly.

With regard to the manufacturability of such prior art window lift brackets, many opportunities for complications and defect arise. We will briefly review the numerous steps involved in producing a window lift bracket as found in the prior art in order to appreciate and elaborate on the aforementioned problems. Initially, a strip of metal is stamped or cut to a desired size. Next, the metal component is stamped, bored or drilled to provide through holes which will be used as described here and below. The stamped metal component is deformed to form a bracket having a generally "Y" shaped cross section. The deformed metal component must now be protected by painting, anodizing or other means to delay the corrosion process. Once protected, plastic mounted clips are positioned in a channel portion of the bracket and secured in the thru holes by use of a heat staking process. The base of the bracket is drilled for receiving a fastener which will be used to attach the bracket to the lift mechanism cross member.

In applying the prior art lift bracket to window, an adhesive is disposed in the channel portion of the lift bracket and the lift bracket is attached to the mounted edge of a movable window. The window, with two or more brackets positioned thereon, is subjected to a heat curing process in order to cure the adhesive. A heat curing adhesive is used in order to properly adhere the adhesive to the surfaces of the bracket and window.

As may be understood from the description hereinabove, there are numerous opportunities for problems to arise in the manufacture of a window lift bracket as set forth by the prior art. For example, if the bracket is not properly formed it may not properly fit on the window or function in the movable window assembly. In each step of the fabrication process a new operation, coating, or joining method is used, each presenting its own opportunity for problems.

For example, as mentioned, clips must be used with the deformed metal bracket in order to prevent the bracket from scratching the window glass and the protective coating on the window. The plastic clips are an individual piece part which must be designed, purchased, and managed in the manufacturing system. The clips are typically produced by selectively cutting an extruded plastic strip. Each clip must be cut to a generally precise dimension thereby requiring an additional inspection step. The clips must also be heat staked to the metal bracket. The heat staking process deforms a portion of the plastic clip over an abutting portion of the metal bracket. If the plastic portion is not properly melted, it may not be securely held to the metal bracket which could result in a release of the window from the bracket under certain circumstances. Clearly, it is not desirable to have a release of the window from the bracket.

Additionally, an adhesive is disposed in a channel portion of the metal bracket to secure the window to the bracket. The adhesive must be selected to attach or adhere to the plastic clip, the metal bracket (or the protective surface of the metal bracket) and the window glass and/or coating. The numerous and diverse material properties involved can make selection of an appropriate adhesive somewhat difficult. Further, if the metal bracket begins to corrode, the corrosion could result in the adhesive detaching from the metal bracket.

As may be clear, there are numerous problems associated with the manufacture and use of metal window lift brackets as currently used in the prior art. As such, it is important to find a window lift bracket which will overcome the problems associated with the prior art devices.

OBJECTS AND SUMMARY OF THE INVENTION

A general object of the present invention is to provide a window lift bracket which will securely attach to a window and a window lifting mechanism.

Another object of the present invention is to provide a window lift bracket which will not corrode.

A still further object of the present invention is to provide a window lift bracket which is efficiently manufactured and eliminates numerous manufacturing steps and the parts required to manufacture a bracket.

Briefly, and in accordance with the foregoing, the present invention envisions a window lift bracket for attachment to a mounting edge of a movable window and which is connectable to a window lifting mechanism. The window lift bracket includes a base which is attachable to the window lifting mechanism and spaced apart portions extending from the base being positionable on either side of the movable window. The spaced apart portions define a channel therebetween. Opposing surfaces of the spaced apart portions include protrusions which abut corresponding surfaces of a window placed in the channel. Depressions are defined by the protrusions and are adapted for receiving an adhesive placed in the channel and effectively increasing the surface area contact of the adhesive on the window bracket thereby improving the adhesion of the adhesive to the window bracket and window. Further, the bracket is integrally formed of a suitable plastics material compatible with the adhesive used to attach the bracket to the window.

DETAILED DESCRIPTION OF THE PREFERRED EMBODIMENT

Figure 1:
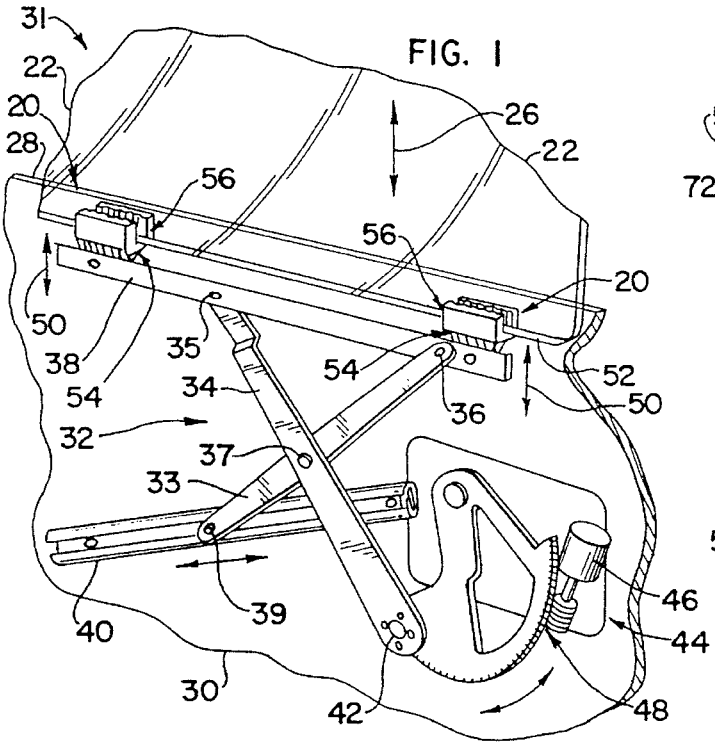
FIG. 1 is a partial fragmentary perspective view of a movie window assembly including a movable window, window lift brackets attached to a mounting edge of the movable window, and a window lifting mechanism connected to the window lift brackets for moving the window assembly.
Figure 3:
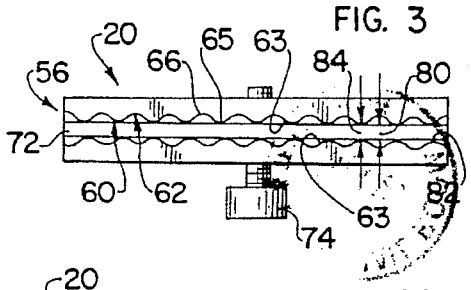
FIG. 3 is a top plan view of the window lift bracket as shown in FIG. 2.
Figure 4:
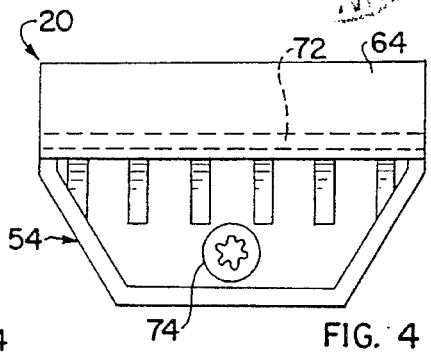
FIG. 4 is a front elevational view of the window lift bracket as shown in FIG. 2.
Figure 2:
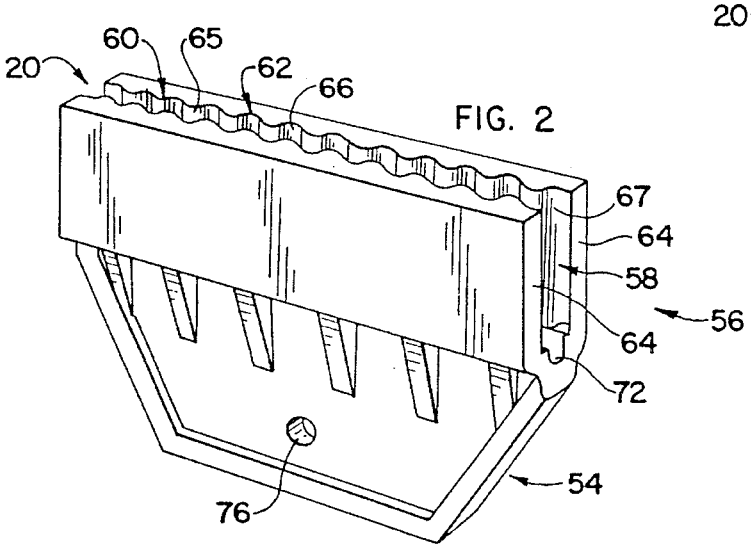
FIG. 2 is an enlarged perspective view of the window lift bracket as shown in FIG. 1 removed from the mounting edge of the movable window.
Figure 5:
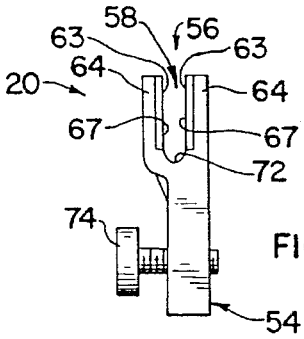
FIG. 5 is a side elevational view of the window lift bracket as shown in FIG. 2.
Figure 6:
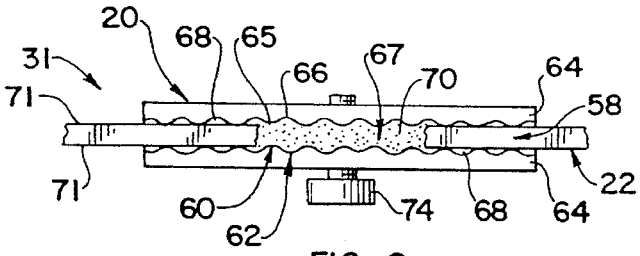
FIG. 6 is a partial fragmentary, top plan view of the window lift bracket as shown in FIG. 1 attached to a mounting edge of a movable window, and in which the window lifting mechanism has been removed in the interest of clarity.
Figure 7:
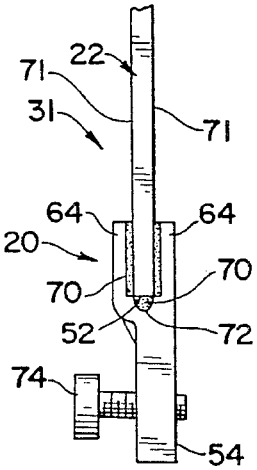
FIG. 7 is a side elevational view of the window lift bracket as shown in FIG. 1, and in which the window lifting mechanism has been removed in the interest of clarity.

While the invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

FIG. 1 shows a window lift bracket 20 attached to a movable window 22 and a window lifting mechanism 24. The window lifting mechanism 24 raises and lowers (as indicated by direction arrow 26) the window 22 relative to an edge 28 of a vehicle panel 30. The window 22 and the attached window lift bracket 20 define a window assembly 31.

The window lifting mechanism 24 includes a lifting linkage 32 which is shown as a scissor type linkage having a first arm 33 and a second arm 34. First ends 36,35 of the first and second arms 33,34 are attached to a cross member 38 and are linked to a common axis 37 generally midway through each arm 33,34. A distal end 39 of the first arm 33 is attached to a guide track 40 which is fixed relative to the vehicle panel 30. A distal end 42 of the second arm 34 is attached to a drive mechanism 44. The drive mechanism 44 includes a drive motor 46 and a gear assembly 48. Operation of the motor 46 drives the gear assembly 48 to move the attached second arm 34 and scissor the lifting linkage 32. The scissoring action of the linkage 32 imparts motion to the cross member 38 (as indicated by direction arrow 50) in a generally vertical direction.

As can be seen in FIG. 1, the window lift bracket 20 provides a critical link between the window lifting mechanism 24 and the movable window 22. The window lift bracket 20 must be easily attachable to and removable from the cross member 38 and securely engage a mounting edge 52 of the window 22 without scratching the glass of the window or a protective coating which is often applied to windows.

With further reference to FIGS. 2–5, the window lift bracket 20 includes means 54 for attaching the bracket to a window lifting mechanism 24, more specifically referred to as a base 54. Spaced apart means 56 are attached to and extend from the base 54 for attaching the bracket 20 to a window 22. The spaced apart means 56 define a channel 58 therebetween in which the mounting edge 52 of the window 22 is fitted. A number of protrusions 60 are formed on an inside surface of the spaced apart means 56 and are adapted for abutting a corresponding surface of a window 22 to which the bracket is attached. Neighboring protrusions 60 define corresponding depressions 62.

As more specifically shown in FIGS. 2–7, the spaced apart means 56 are formed as generally upstanding, spaced apart sidewalls 64 attached to and extending from the base 54. Inside facing surfaces 63,63 of the sidewalls 64,64 include the protrusions 60 which are shaped as ridges 65 and corresponding depression shaped as troughs 66. The ridges 65 and troughs 66 define a convoluted inside surface 67. The ridges 65 of the convoluted inside surface 67 of each sidewall 64 abut a corresponding surface of a portion of a window 22 positioned in the channel 58.

The convoluted surfaces 67 increase the effective surface area of the inside surface of the walls 64,64 to increase the contact surface between an adhesive 70 applied to the convoluted surface 71,71 67 and the corresponding surfaces of the window 22. Each trough 66 and a corresponding surface of the window 22 positioned in the channel 58 defines a gap 68. The adhesive 70 is disposed in the channel 58 for contact between the convoluted surface 67 and the window 22. The adhesive 70 is retained in the gap 68 which provides greater surface area for adhesion to the adhesive material due to the shape of the ridges 65 and troughs 66.

In order to provide even greater holding forces between the adhesive 70 applied to the bracket 20 and the window 22, a groove 72 is formed in the bracket 20 between the spaced apart walls 64 for receiving adhesive material therein. The groove 72 generally runs the length of the bracket 20 to provide additional holding forces between the surface of the bracket positioned proximate to the groove 72, the adhesive 70 retained within the groove 72, and the mounting edge 52 of the window 22.

One type of adhesive which is used in the attachment of the present bracket 20 to a window 22 requires a heat curing process. As such, the adhesive 70 is applied between the window 22 and the bracket forming bonds between the surfaces defining the gaps 68 and the groove 72. The window 22 and the attached window lift brackets 20 define the movable window assembly 31 which is subjected to a heated environment to cure the adhesive 70. In this regard, it is preferable to form the bracket 20 of a suitable plastics material which can withstand the temperature range required for heat curing the adhesive 70.

The bracket 20 is formed of a plastics material which allows the bracket to be integrally formed as unitary single piece body. A material such as injection molded glass filled nylon plastic may be used. Such material will provide the manufacturing benefits of plastic without compromising, and perhaps improving, the structure characteristics of the lift bracket 20.

Unitary forming of the bracket 20 eliminates the numerous manufacturing steps and, perhaps, inspection steps required in the prior art. Further, the plastic bracket 20 of the present invention eliminates the need for individually manufactured and assembled clips to prevent scratching the glass and protective coating of the window. The bracket 20 as shown is attached to the cross member 38 by a single fastener 74 which extends through a bore 76 formed in the base 54. Use of a single fastener 74 to attach the bracket 20 to a cross member 38 helps to simplify the installation process and further reduces the weight of the overall vehicle assembly.

The plastics material used in forming the bracket 20 will not corrode thereby eliminating corrosion failure which may occur and the prior art and the need for additional manufacturing steps such as coating of the metal bracket to delay the corrosion process. The plastics material greatly reduces the weight of the bracket which may provide a noticeable cumulative effect since two brackets are often used per window which result in the use of eight brackets per vehicle thereby providing eight times the weight reduction per vehicle when comparing the plastic bracket 20 to a prior art metal bracket.

The ridges 65 are generally oriented on the convoluted surface 67 of each sidewall 64 generally parallel to the direction of travel 26 of the window. Likewise, the troughs 66 positioned between the ridges 65 are generally parallelly oriented relative to the direction of travel 26 of the window 22. The ridges 65 provide a strengthening rib in the sidewall 64 construction.

A dimension 84 measured between corresponding tips or crests 82 of the ridges 65 is slightly smaller than a dimension 80 measured through the window 22 which produces a biasing force in the spaced apart means 56 of the bracket 20. The biasing force is created when the sidewalls 64 are urged outwardly away from each other due to the dimensional difference between the dimensions 80 and 84. The biasing force creates an engaging force in the bracket 20 which to provide holding forces or additional holding forces to retain the bracket 20 on the window 22.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A unitary molded bracket for attachment to a movable window to facilitate connection of said window to a window lifting mechanism, said bracket comprising:

a base for attaching said bracket to said window lifting mechanism;

spaced apart sidewalls attached to and extending from said base, said sidewalls defining a channel therebetween sand being adapted for fitting said bracket to a corresponding mounting edge of said window; and a multiplicity of generally equally spaced apart elongated ridges and troughs formed on a window abutting surface of at least one of said sidewalls, said ridges abutting a corresponding surface of said window positioned in said channel and said troughs receiving an adhesive material for attaching said bracket to side surfaces of said window.

2. A bracket as recited in claim 1, wherein said adhesive material is heat curable and said bracket is formed of a plastics material suitable for withstanding the temperature range for heat curing of said adhesive.

3. A bracket as recited in claim 1, said sidewalls comprising two generally continuous, planar sidewalls, said ridges being oriented generally parallel to the direction of travel of said window, neighboring pairs of ridges defining corresponding ones of said troughs, said troughs and an opposing surface of said window positioned in said channel defining a gap therebetween, said gap being adapted for receiving an adhesive material therein for attaching said bracket to said window.

4. A bracket as recited in claim 1, wherein a dimension measured between corresponding crests of said ridges being slightly smaller than a corresponding dimension measured through said window for producing a biasing force in said bracket between said sidewalls.

5. A bracket as recited in claim 1, further comprising an elongated groove being formed in a portion of said bracket between said spaced apart sidewalls, said elongated groove being adapted for receiving adhesive therein for attaching said bracket to a corresponding bottom edge of said window placed between said spaced apart sidewalls proximate to said elongated groove, said adhesive in said groove attaching to a surface of said bracket in said groove and said edge of said window.

6. A movable window assembly for connection to a window lifting mechanism, said window assembly comprising: a window having two surfaces and a mounting edge therebetween; at least one bracket attached to said mounting edge of said window and corresponding portions of said two surfaces, said bracket being formed of a molded plastic material including a mounting portion for connecting said bracket to said window lifting mechanism and spaced apart means extending from said mounting portion, said spaced apart means defining a channel therebetween, said window being positioned in said channel for fitting said bracket to said mounting edge of said window, elongated, generally equally spaced apart protrusions and depressions being formed on at least one inner surface of said spaced apart means; and an adhesive material disposed in said channel and said depressions for attaching said bracket to said window.

7. A window assembly as recited in claim 6, wherein said adhesive material is heat curable and said bracket is formed of a plastics material suitable for withstanding the temperature range for heat curing of said adhesive.

8. A window assembly as recited in claim 6, said spaced apart means comprising two generally continuous, planar sidewalls, said protrusions and depressions defining generally equally spaced, elongated ridges and troughs on an inside surface of each of said sidewalls, said ridges and troughs being oriented generally parallel to the direction of travel of said window, neighboring pairs of ridges defining corresponding ones of said troughs therebetween, said troughs and an opposing surface of said window positioned in said channel defining a gap therebetween, said gap being adapted for receiving an adhesive material therein for attaching said bracket to said window.

9. A window assembly as recited in claim 6, further comprising an elongated groove being formed in a bottom portion of said channel between said spaced apart means, said elongated groove being adapted for receiving adhesive therein for attaching said bracket to a corresponding bottom edge of said window placed in said channel proximate to said elongated groove.

10. A window assembly as recited in claim 6, wherein a dimension measured between corresponding crests of said elongated protrusions is slightly smaller than a corresponding dimension measured through said window for producing a biasing force in said bracket between said spaced apart means for creating engaging forces in said bracket for holding said bracket on said window.

11. A bracket for attachment to a movable window to facilitate connection of said window to a window lifting mechanism, said bracket comprising: means for connecting said bracket to said window lifting mechanism; spaced apart sidewalls attached to said connecting means, said spaced apart sidewalls having inside surfaces defining a channel therebetween, at least one of said inside surfaces of said spaced apart sidewalls defining a convoluted surface thereon; and attaching material disposed between and contacting said convoluted surface of said sidewalls and said window for attaching said bracket to said window.

12. A bracket as recited in claim 11, said convoluted surface further comprising a multiplicity of elongated, generally equally spaced apart protrusions and depressions, said protrusions being adapted for abutting surfaces of said window, and said depressions being adapted for receiving attaching material therein for attaching said bracket to said window.

13. A bracket as recited in claim 12, said protrusions further comprising elongated, arcuate ridges formed on oppositely disposed surfaces of said spaced apart sidewalls, said ridges being adapted for positively engaging abutting surfaces of said window, neighboring ridges defining corresponding elongated, arcuate troughs.

14. A bracket as recited in claim 13, wherein a dimension measured between corresponding crests of said ridges is slightly smaller than a corresponding dimension measured through said window for producing a biasing force in said bracket between said spaced apart sidewalls for creating engaging forces in said bracket for holding said bracket on said window.

15. A bracket as recited in claim 13, wherein said ridges and troughs are generally equally spaced along said inside surface of said spaced apart sidewalls and are oriented generally parallel relative to the direction of travel of said window.

16. A bracket as recited in claim 11, said attaching material further comprising adhesive material placed in said channel adapted for adhering to said convoluted inside surface of said bracket and to said window.

17. A bracket as recited in claim 11, further comprising an elongated groove in a bottom portion of said channel between said spaced apart sidewalls, said groove receiving adhesive therein for attaching said bracket to a corresponding edge of said window placed in said channel.

* * * * *

UNITED STATES PATENT AND TRADEMARK OFFICE

CERTIFICATE OF CORRECTION

PATENT NO. : 5,513,468

DATED : May 7, 1996

INVENTOR(S) : Stephen Diestelmeier

It is certified that error appears in the above-indentified patent and that said Letters Patent is hereby corrected as shown below:

Column 2, Line 67 "movie" should be — movable —

Column 5, Lines 45-46 "therebetween sand" should be — therebetween and —

Signed and Sealed this

Twenty-fourth Day of September, 1996

*Attest:*

BRUCE LEHMAN

*Attesting Officer*

*Commissioner of Patents and Trademarks*